US005497932A

United States Patent [19]

Brewer et al.

[11] Patent Number: 5,497,932

[45] Date of Patent: Mar. 12, 1996

[54] MANUALLY OPERATED FASTENING DEVICE

[75] Inventors: Kevin D. Brewer, Maytown, Pa.; Stephen A. Debelius, Phoenix, Md.

[73] Assignee: Emhart Inc., Newark, Del.

[21] Appl. No.: 289,213

[22] Filed: Aug. 12, 1994

[51] Int. Cl.[6] ..... B25C 5/06

[52] U.S. Cl. ..... 227/132

[58] Field of Search ..... 227/120, 125, 227/126, 132, 139

[56] References Cited

U.S. PATENT DOCUMENTS

| | | | |
|---|---|---|---|
| 2,310,529 | 3/1943 | Krantz . | |
| 2,326,540 | 8/1943 | Krantz . | |
| 2,493,640 | 1/1950 | Peterson . | |
| 2,668,290 | 2/1954 | Heller . | |
| 2,671,215 | 3/1954 | Abrams . | |
| 2,746,043 | 5/1956 | Heller . | |
| 2,746,044 | 5/1956 | Cusumano et al. . | |
| 2,769,174 | 11/1956 | Libert . | |
| 2,822,544 | 4/1955 | Anstett . | |
| 2,994,878 | 8/1961 | Abrahamsen . | |
| 3,199,185 | 8/1965 | Lash et al. . | |
| 3,229,882 | 1/1966 | Abrams . | |
| 3,275,212 | 9/1966 | Johnson . | |
| 3,610,505 | 10/1971 | Males et al. . | |
| 3,758,016 | 9/1973 | Olney et al. . | |
| 3,862,712 | 1/1975 | LaPointe et al. . | |
| 3,948,426 | 4/1976 | La Pointe . | |
| 4,119,258 | 10/1978 | Ewig, Jr. . | |
| 4,126,260 | 11/1978 | Mickelsson . | |
| 4,150,774 | 4/1979 | Wright . | |
| 4,156,499 | 5/1979 | Frank . | |
| 4,184,620 | 1/1980 | Ewig . | |
| 4,189,082 | 2/1980 | Solomon . | |
| 4,225,075 | 9/1980 | Chi . | |
| 4,367,833 | 1/1983 | Kenney . | |
| 4,399,938 | 8/1983 | Biddle . | |
| 4,432,484 | 2/1984 | Maestri . | |
| 4,450,998 | 5/1984 | Ruskin . | |
| 4,452,388 | 6/1984 | Fealey . | |
| 4,629,108 | 12/1986 | Judge . | |
| 5,009,356 | 4/1991 | Chang . | |
| 5,165,587 | 11/1992 | Marks . | |
| 5,407,118 | 4/1995 | Marks | 227/132 |
| 5,427,299 | 6/1995 | Marks | 227/132 |

FOREIGN PATENT DOCUMENTS

| | | |
|---|---|---|
| 920103 | 3/1963 | European Pat. Off. . |
| 0254775 | 2/1988 | European Pat. Off. . |
| 0281541 | 9/1988 | European Pat. Off. . |
| 964854 | 5/1957 | Germany . |
| 255111 | 1/1949 | Switzerland . |
| 807937 | 1/1959 | United Kingdom . |
| 1364336 | 8/1974 | United Kingdom . |

*Primary Examiner*—Scott A. Smith
*Attorney, Agent, or Firm*—J. Bruce Hoofnagle

[57] ABSTRACT

An impact stapler (100) includes an actuator mechanism (110) comprising a firing lever (180) pivotally mounted on a stapler housing (102) and operable by an operating lever (160) for raising a striker (112) against the bias of an actuator spring (240). The firing lever (180) has a front tip (190) which is positioned to engage a tab (272) on the striker (112) when the operating lever (160) is actuated to raise the striker (112) and which is shifted laterally to disengage the front tip (190) from the tab (272) to release the striker (112) for actuation by the actuator spring (240) after the striker (112) is raised. The impact stapler (100) includes a resilient finger (292) for shifting the firing lever (180) laterally to a rest position with the front tip (190) underneath the tab (272) on the striker (112). A stop (295) engages the firing lever (180) in its rest position to limit the bending of the resilient finger (292) and to locate the front tip (190) in a predetermined lateral position relative to the tab (272) on the striker (112).

28 Claims, 13 Drawing Sheets

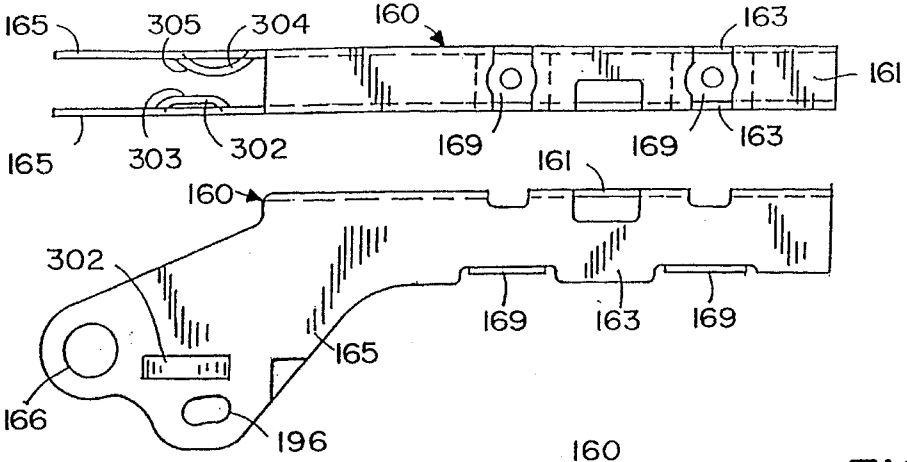
FIG. 15
FIG. 16
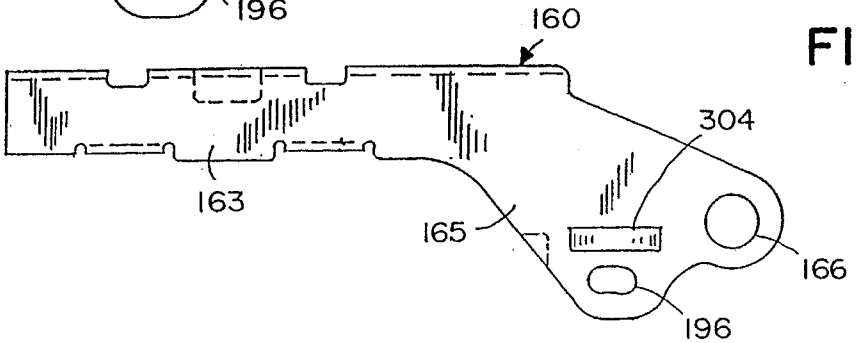
FIG. 17
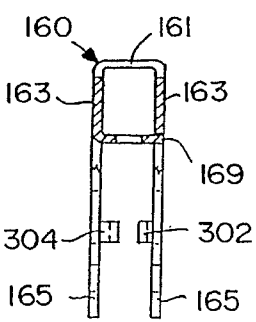
FIG. 18
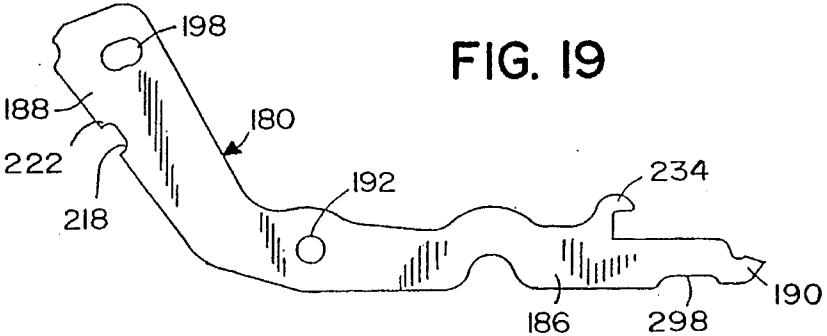
FIG. 19
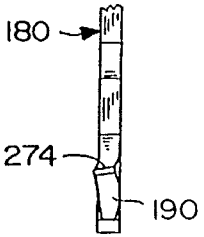
FIG. 20

MANUALLY OPERATED FASTENING DEVICE

FIELD OF THE INVENTION

The present invention relates to a manually operated fastening device and, more particularly, to an improved actuator mechanism for use in a manually operated impact stapler.

BACKGROUND OF THE INVENTION AND PRIOR ART

Manually powered impact type stapling and tacking machines are well known. Such devices generally comprise a housing, an energy storage spring, a fastener feeding system, a movable operating handle to deflect the energy storage spring, a mechanism to rapidly disengage the handle from the deflected spring, and a sliding plunger linked to the spring to impact and drive a fastener from the housing. Examples of such impact type stapling machines are disclosed in Krantz U.S. Pat. No. 2,326,540, Abrams U.S. Pat. No. 2,671,215, Libert U.S. Pat. No. 2,769,174, Males et al U.S. Pat. No. 3,610,505, and Fealey U.S. Pat. No. 4,452,388.

In the impact stapler of Marks U.S. Pat. No. 5,165,587, an upper lever pivotally mounted toward the rear of the stapler housing is depressed to actuate a pivotally mounted lower lever for raising a striker against the bias of an actuator coil spring engaging the rear of the lower lever. After the striker is raised, a linkage which connects the upper lever to the lower lever is disengaged to release the lower lever for actuation by the coil spring which drives the striker downward to eject a fastener from the stapler housing. The linkage is re-engaged when the operating handle is released and returned to its rest position prior to the next power stroke.

In the impact stapler of co-pending U.S. application Ser. No. 08/074,941, filed Jun. 10, 1993, an upper lever is pivotally mounted toward the rear of the stapler housing and is coupled by a pin and slot connection to a lower lever pivotally mounted on the stapler housing. An actuator leaf spring is coupled to a staple striker at the front of the housing. When the upper lever is depressed to pivot the lower lever, a tab on the striker is engaged by the front tip of the lower lever and the striker is raised against the bias of the leaf spring. When the striker is raised to the top of its power stroke, the lower lever is shifted by a camming action on its front tip in a first lateral direction to position the front tip to one side of the striker tab and to release the striker which is driven downward by the leaf spring to eject a staple from the stapler housing. When the upper lever is released, the lower lever is shifted in a second lateral direction by a return spring acting on a rear portion of the lower lever to position the front tip on the opposite side of the striker tab. The lower lever is pivoted to its rest position by the return spring which engages a cam on the stapler housing and shifts the lower lever in the first lateral direction to position the front tip underneath the striker tab for the next power stroke.

The present invention provides an improved fastening device of the type disclosed in the copending U.S. application Ser. No. 08/074,941 including an improved actuator mechanism with a reset device which eliminates the need for using the return spring to perform the dual function of shifting the lower lever laterally in one direction after the striker is driven downward and shifting the lower lever laterally in the opposite direction for engagement with the striker tab when the lower lever is returned to its rest position. Also, the invention provides an improved actuator mechanism including a lateral positioning feature for accurately locating the lower lever in a predetermined lateral position relative to the striker tab.

SUMMARY OF THE INVENTION

A primary object of the invention is to provide an impact type fastening device with an improved actuator mechanism which is reliable in operation and easily and accurately assembled.

The present invention is particularly concerned with an impact type stapler including an actuator mechanism comprising an operating lever for actuating a firing lever which engages a spring-biased striker to raise the striker against the bias of an actuator spring, wherein the firing lever is shifted laterally at the top of its power stroke to disengage and release the striker for actuation by the actuator spring, and wherein the firing lever is accurately reset for engagement with the striker when the actuator mechanism is returned to a rest position for the next power stroke of the stapler.

In accordance with one aspect of the invention, as embodied and described herein, a fastening device comprises a housing, an operating lever pivotally mounted on the housing, a striker located within the housing and oriented to drive a fastener from the housing, and an actuator spring coupled to the striker and adapted to bias the striker for driving the fastener from the housing. A firing lever is pivotally mounted on the housing and operable by the operating lever for raising the striker against the bias of the actuator spring. The firing lever is adapted to shift laterally relative to the striker and is normally located in a rest position. The firing lever is positioned to engage the striker when the operating lever is actuated to raise the striker and the firing lever is shifted laterally to release the striker for actuation by the actuator spring after the striker is raised. Reset means is provided adjacent to the striker for shifting the firing lever laterally into its rest position.

To facilitate the return of the firing lever accurately to its rest position, the reset means is mounted on the housing at a position adjacent to the striker and acts on a portion of the firing lever adjacent to the striker. The reset means is embodied as a resilient biasing member mounted on the housing and adapted to engage a portion of the firing lever adjacent to the striker for urging the firing lever in a lateral direction to its rest position.

A preferred embodiment of the reset means comprises a resilient finger mounted on the housing adjacent to the striker for urging the firing lever in a lateral direction to its rest position. A stop is located adjacent to the striker to engage the firing lever in its rest position to locate the firing lever in a predetermined lateral position relative to the striker.

In a preferred embodiment of the fastening device, the firing lever is positioned underneath a tab on the striker when the operating lever is actuated to raise the striker. The firing lever is shifted in a first lateral direction to one side of the tab to release the striker for actuation by the actuator spring after the striker is raised. A return spring is provided for normally biasing the firing lever toward a rest position. The return spring is adapted to urge the firing lever in a second lateral direction to shift the firing lever to the opposite side of the tab after the striker is actuated. Reset means is provided adjacent to the striker for shifting the firing lever in the first lateral direction into its rest position underneath the striker tab. The reset means comprises a resilient biasing member mounted on the housing and adapted to engage a portion of the firing lever adjacent to the striker for urging the firing lever in the first lateral direction to its rest position. The resilient biasing member is adapted to counterbalance the action of the return spring on the firing lever in its rest position to maintain the firing lever underneath the tab.

In accordance with another aspect of the invention, the operating lever has a pair of opposed lugs which receive a portion of the firing lever therebetween and engage opposite sides of the firing lever to guide the movement of the firing lever relative to the operating lever. The lugs consist of inwardly projecting lances formed on opposite sides of the firing lever. One of the lugs has flat bearing surface and the other lug has a rounded bearing surface for engaging the firing lever.

BRIEF DESCRIPTION OF THE DRAWINGS

The foregoing and other objects, aspects and advantages of the present invention will be better understood from the following detailed description of the preferred embodiments of the invention with reference to the drawings, in which:

FIG. 15 is a top view of an operating lever which forms part of the staple actuator mechanism;

FIG. 16 is a side view showing one side of the operating lever of FIG. 15;

FIG. 17 is a side view showing the opposite side of the operating lever of FIG. 15;

FIG. 18 is a partially cutaway end view of the operating lever of FIG. 17;

FIG. 19 is a side view of a firing lever which forms part of the staple actuator mechanism;

FIG. 20 is an enlarged front view showing the front tip of the firing lever of FIG. 19;

DETAILED DESCRIPTION OF PREFERRED EMBODIMENTS

Figure 1:
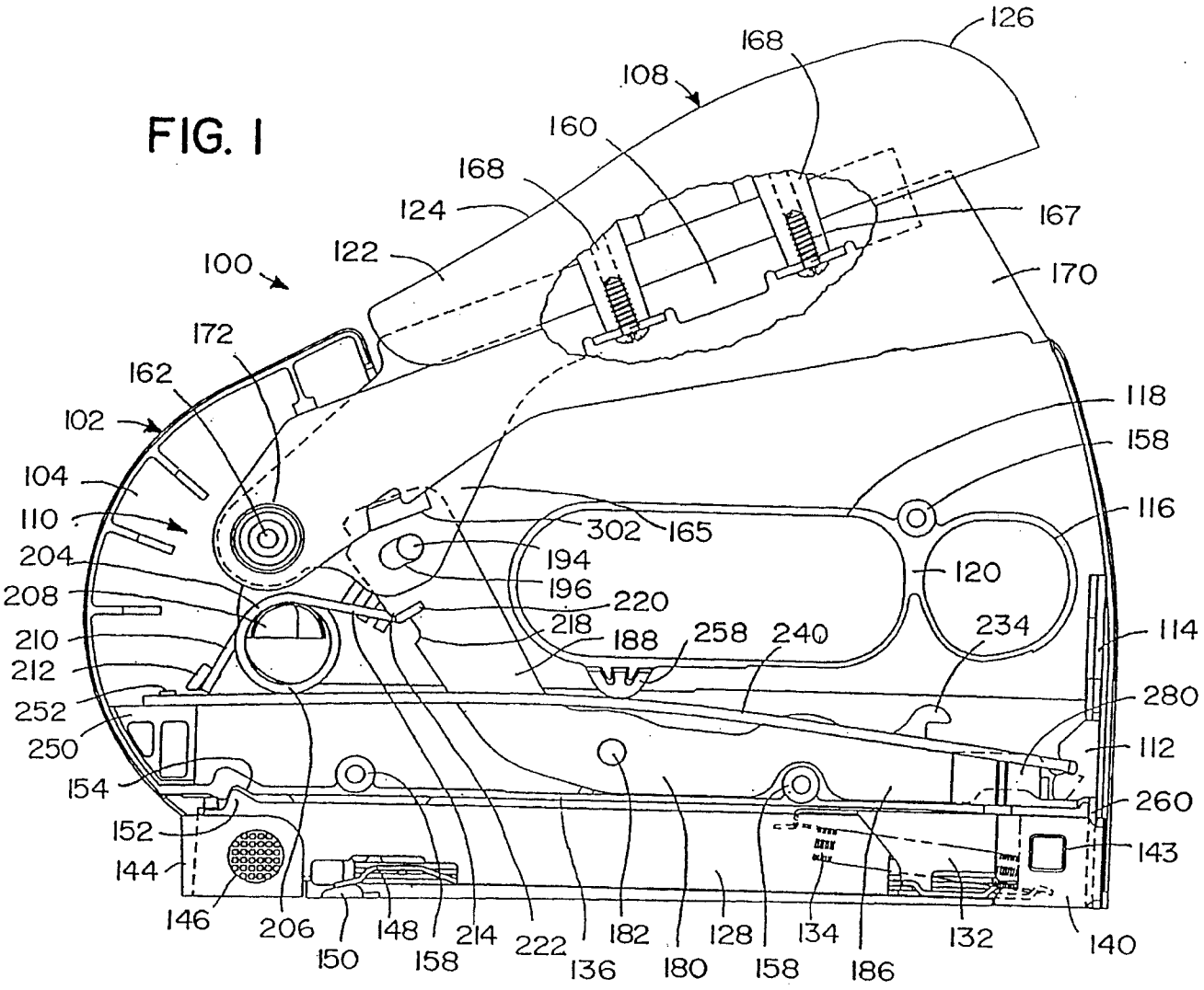
FIG. 1 is a partially cutaway side view of a stapler constructed in accordance with the present invention with one of its housing sections removed to show a staple actuator mechanism.
Figure 2:
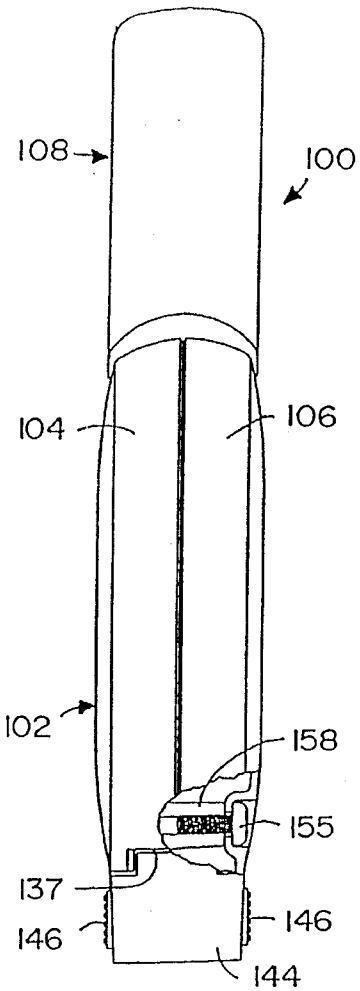
FIG. 2 is a partially cutaway rear view of the stapler of FIG. 1.

Referring to FIGS. 1 and 2, the invention is embodied in a fastening device, generally 100, e.g., a manually operated impact stapler, with a two-part housing 102 which is split longitudinally and includes a pair of mating housing sections 104 and 106 containing the other stapler components. An actuator handle assembly, generally 108, is pivotally mounted toward the rear of the stapler housing 102 and is inclined upwardly toward the front of the stapler housing 102. The actuator handle assembly 108 forms part of a staple actuator mechanism, generally 110, for actuating a staple striker 112 which is mounted for reciprocation in a vertical track 114 (FIGS. 5 and 7) formed on the interior and adjacent to the front of each of the housing sections 104 and 106.

Each of the housing sections 104 and 106 consists of die cast metal and includes a front opening 116 for receiving the index finger of the hand of an operator gripping the stapler 100. An elongated opening 118 is provided in each of the housing sections 104 and 106 for receiving the remaining fingers of the hand of the operator. A finger stop 120 separates the openings 116 and 118 in each of the handle sections 104 and 106 and provides a surface for the middle finger to support the stapler 100 when it is held in a vertical position. The actuator handle assembly 108 has a cover-shaped handle 122 formed of molded plastic material which has a gradually curved upper surface 124 and a rounded front end 126 to accommodate the thumb of the operator and facilitate the actuation the stapler 100.

Figure 3:
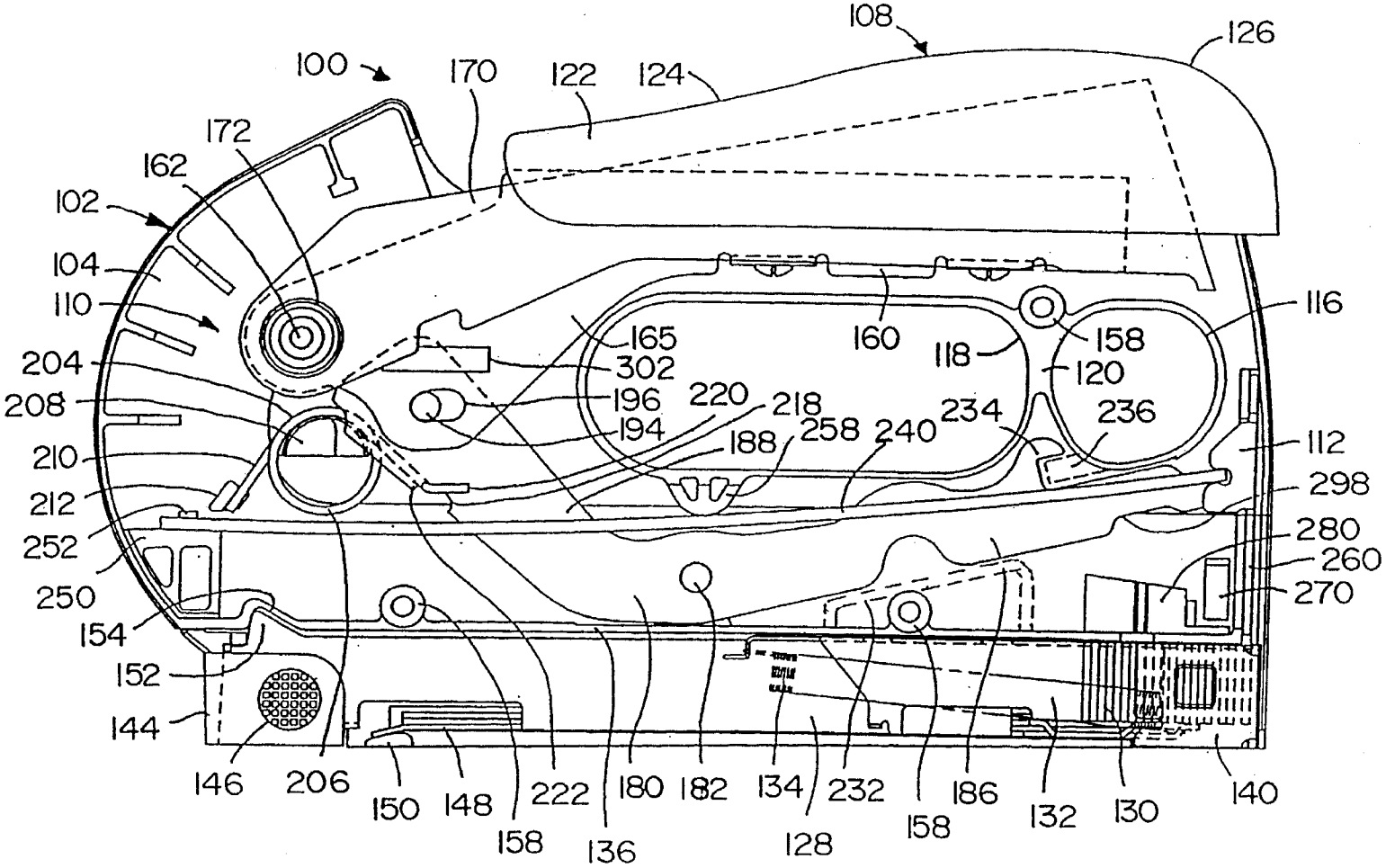
FIG. 3 is a partially cutaway side view of the stapler of FIG. 1 showing the staple actuator mechanism at the top of its power stroke.
Figures 5, 6:
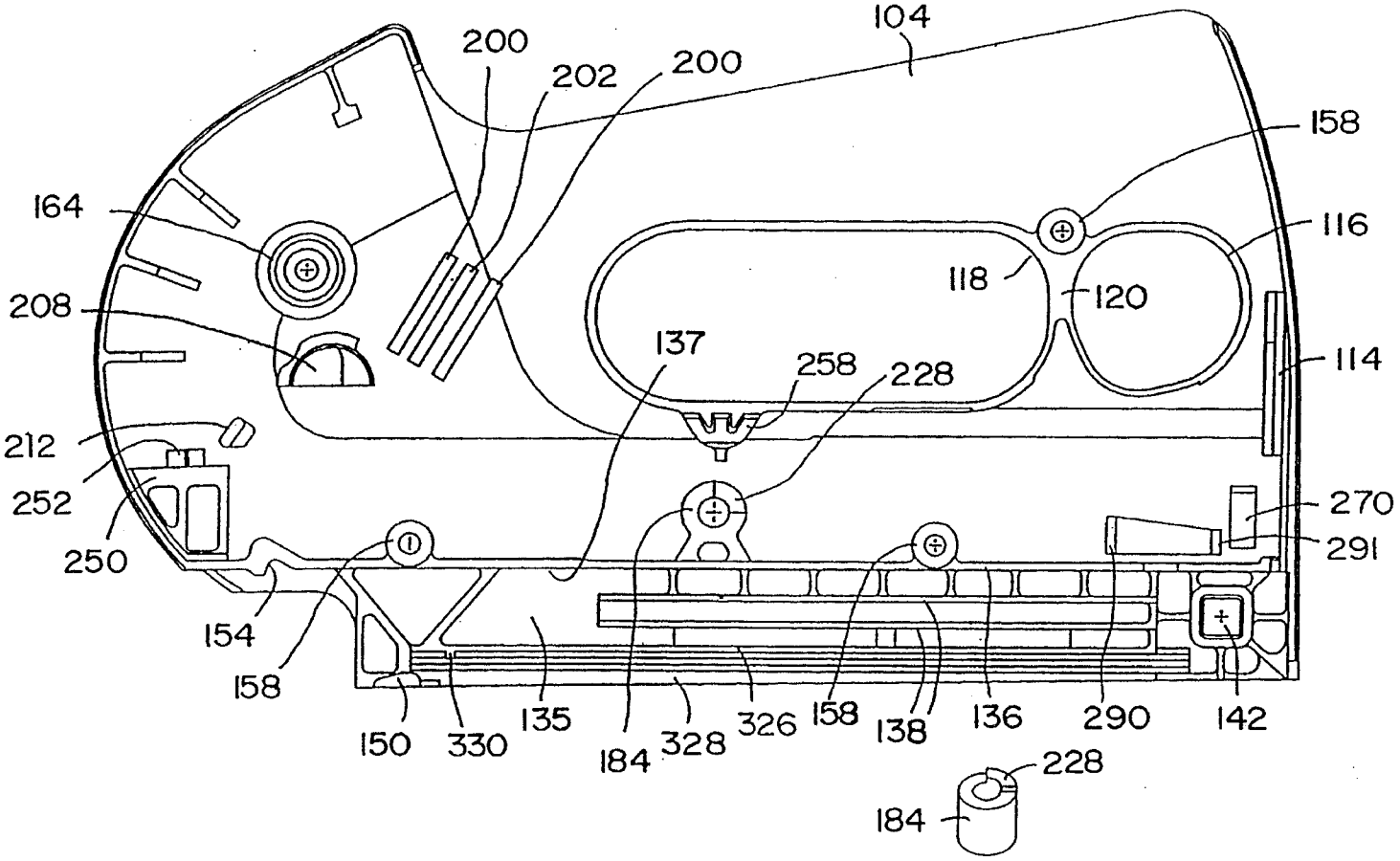
FIG. 5 is a side view showing the interior of one of the housing sections of the stapler with the staple actuator mechanism removed.
FIG. 6 is a fragmentary perspective view of a lever support boss formed on the interior of the housing section of FIG. 5.
Figures 7, 8:
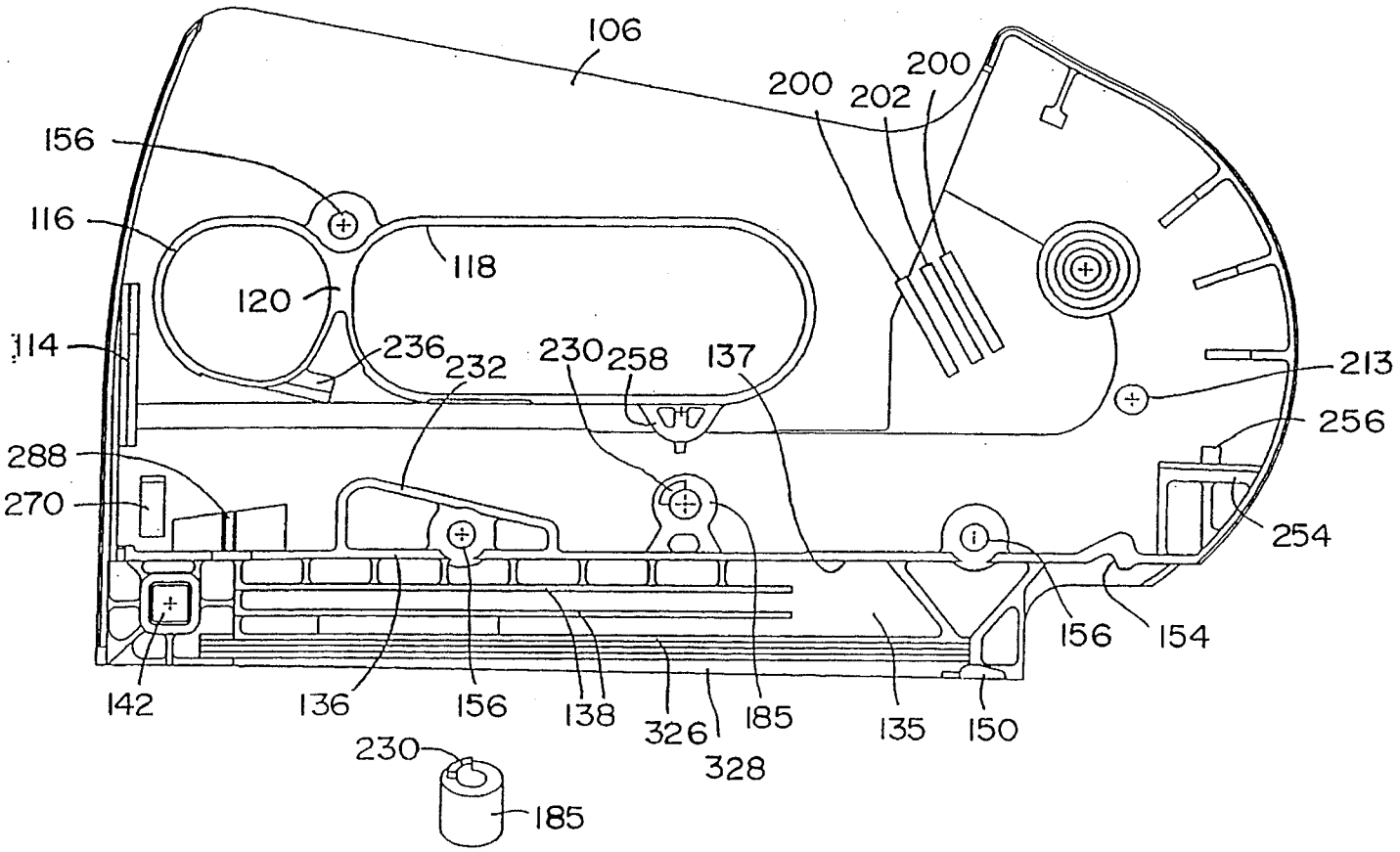
FIG. 7 is a side view showing the interior of the other housing section of the stapler with the staple actuator mechanism removed.
FIG. 8 is a fragmentary perspective view showing a lever support boss formed on the interior of the housing section of FIG. 7.

At the bottom of the stapler housing 102, a staple guide track 128 is mounted for receiving and guiding a plurality of fasteners or staples 130 (FIG. 3) toward the front of the stapler housing 102. A staple pusher 132 is slidably mounted on the staple guide track 128 and is pulled forwardly by a tension spring 134 to urge the staples 130 toward the front of the housing 102. As shown in FIGS. 5 and 7, each of the housing sections 104 and 106 includes an elongated rectangular side wall 135 and a longitudinal wall 136 extending along substantially the entire length of the stapler housing 102 which provide a channel 137 at the bottom of the stapler 100 for receiving the staple guide track 128 and the staples 130. A pair of elongated ribs 138 is formed on each of the side walls 135 below the longitudinal wall 136 on each of the housing sections 104 and 106 to guide the staples 130 along the staple guide track 128 toward the striker 112.

A U-shaped nosepiece 140 (FIG. 1) is mounted on opposed rectangular bosses 142 (FIGS. 5 and 7) adjacent to the front of the housings sections 104 and 106 for guiding the staples 130 into alignment with the striker 112. When the striker 112 is raised, the frontmost staple 130 is urged against the front wall of the nosepiece 140 by the staple pusher 132 and is aligned with the striker 112. A pair of rectangular openings 143 is formed in the opposite side walls of the nosepiece 140 for receiving the rectangular bosses 142 on the housing sections 104 and 106.

A U-shaped track pull member 144 (FIGS. 1 and 2) is connected to the rear end of the staple guide track 128 and provided with gripping pads 146 on its opposite sides to enable the operator to slide the staple guide track 128 rearwardly to load the staples 130 into the channel 137 at the bottom of the stapler 100. Normally, the staple guide track 128 is retained in the stapler housing 102 by a leaf spring 148 extending from the bottom of the staple guide track 128 and engaging a ledge 150 formed at the bottom of each of the side walls 135 to urge a pair of lugs 152 formed at the top of the staple guide track 128 into a pair of notches 154 formed in the longitudinal walls 136 of the housing sections 104 and 106.

The housing sections 104 and 106 are assembled by a plurality of screws 155 (one shown in FIG. 2). The screws 155 are inserted into a plurality of screw holes 156 (FIG. 7) formed in the housing section 106 and are threaded into a corresponding set of screw-receiving bosses 158 (FIG. 5) formed on the housing section 104.

Referring to FIG. 1, the staple actuator mechanism 110 includes an upper operating lever 160 which is pivotally mounted on a pivot pin 162 located toward the rear of the housing 102. The pivot pin 162 is received in a pair of opposed cylindrical bosses 164 (FIGS. 5 and 7) formed on the interior of the housing sections 104 and 106. As shown in FIGS. 15–18, the operating lever 160 comprises a flat metal plate which is bent into a channel-shaped configuration to provide a top wall 161 and a pair of side walls 163 including a pair of rearwardly extending depending flanges 165. The flanges 165 have a pair of circular holes 166 formed toward the rear which receive the pivot pin 162 to support the operating lever 160 for pivotal movement relative to the housing 102. As shown in FIG. 1, the operating lever 160 is attached to the handle 122 by a pair of screws 167 which are threaded into a pair of hollow cylindrical stems 168 extending downward from the handle 122. The screws 167 are inserted through a pair of flanges 169 (FIG. 16) which are folded inwardly from one of the side walls 163 of the operating lever 160.

Figure 11:
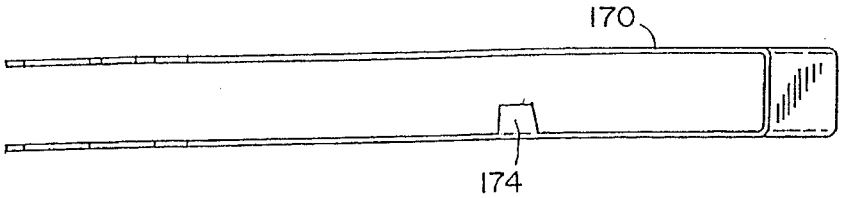
FIG. 11 is a top view showing the sleeve of FIG. 10.
Figure 10:
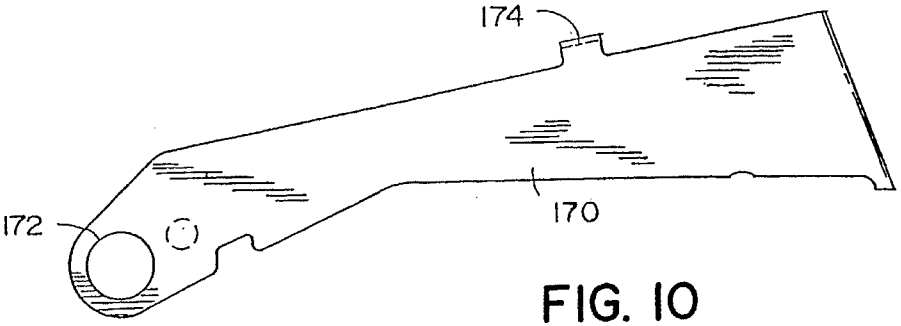
FIG. 10 is a side view of a sleeve which forms part of the staple actuator mechanism.

As shown in FIG. 1, an elongated channel-shaped sleeve 170 is loosely mounted underneath the handle 122 and overlaps the operating lever 160. The sleeve 170 has a pair of circular holes 172 (FIG. 10) formed toward the rear which receive the cylindrical bosses 164 on the housing sections 104 and 106 to support the sleeve 170 for pivotal movement relative to the housing 102. As shown in FIGS. 10 and 11, the sleeve 170 has an inwardly projecting top flange 174 which rests on the top of the operating lever 160. The sleeve 170 protects the components of the staple actuator mechanism 110 located inside the stapler housing 102 and prevents the fingers of the operator from being pinched between the housing 102 and the operating lever 160 when the stapler 100 is actuated.

Figure 4:
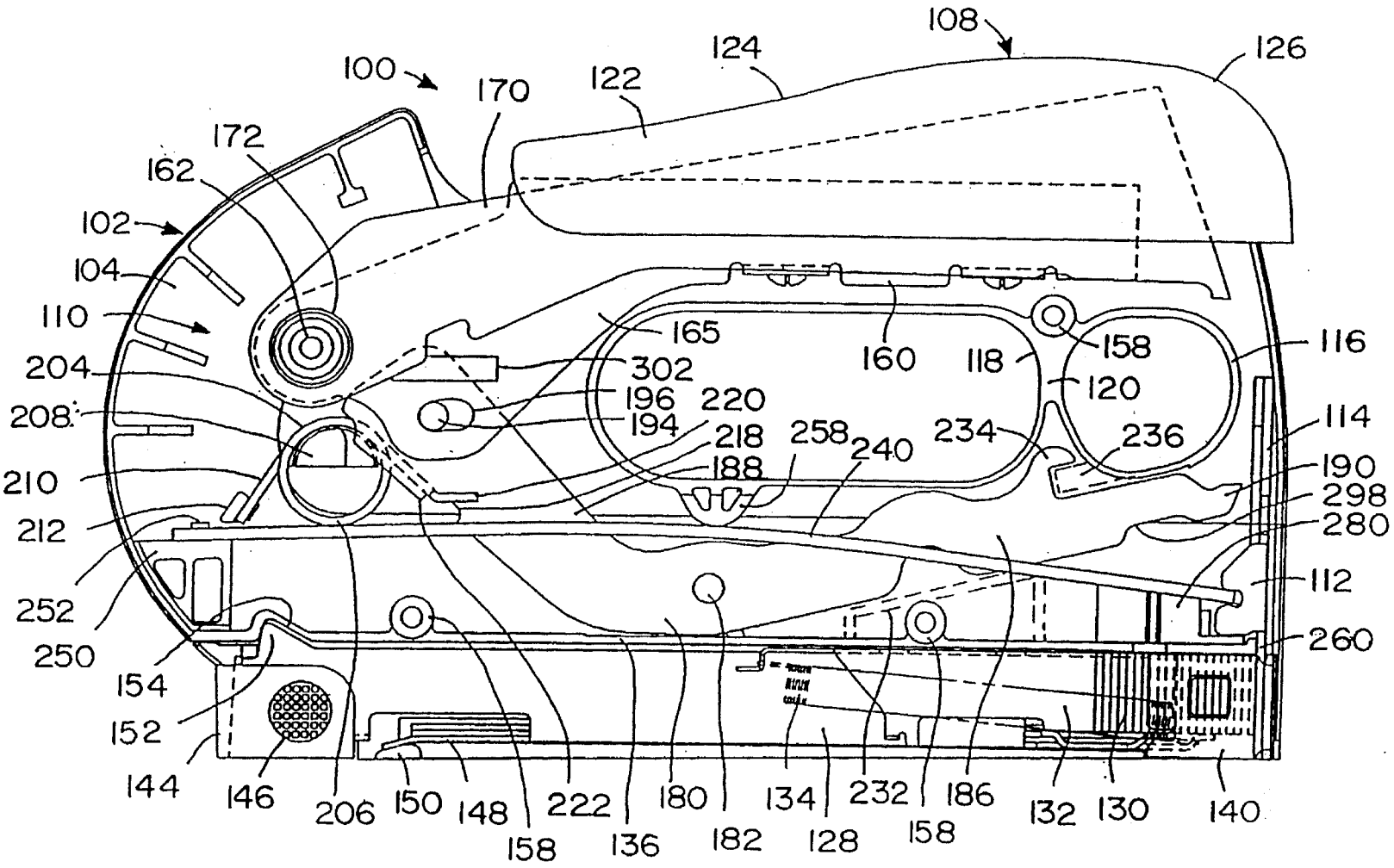
FIG. 4 is a partially cutaway side view of the stapler of FIG. 1 showing the staple actuator mechanism at the end of its power stroke.

The staple actuator mechanism 110 includes a lower firing lever 180 which is pivotally mounted on a pivot pin 182 located toward the bottom of the stapler housing 102 approximately midway between the front and rear of the stapler housing 102. The pivot pin 182 is mounted in a pair of cylindrical bosses 184 and 185 (FIGS. 5 and 7) formed on the interior of the housing sections 104 and 106, respectively. The lower firing lever 180 consists of a flat metal plate including an elongated front portion 186 extending toward the striker 112 and having an upwardly angled rear portion 188 which is overlapped by the pair of depending flanges 165 formed on the opposite sides of the upper operating lever 160. The firing lever 160 has a front tip 190 (FIG. 4) for raising the striker 112 when the actuator mechanism 110 is operated.

Referring to FIGS. 1 and 19, the lower firing lever 180 includes a pivot hole 192 having a slightly larger diameter than the pivot pin 182 to provide a loose pivot connection which supports the lower firing lever 180 for pivotal movement about the axis of the pivot pin 182 and allows the lower firing lever 180 to rock sideways with a wobble-like motion about the pivot pin 182 relative to the housing sections 104 and 106. The rocking motion of the lower firing lever 160 enables the front portion 186 and the front tip 190 of the firing lever 180 to be shifted laterally relative to the striker 112.

As shown in FIG. 1, the upper operating lever 160 is coupled to the lower firing lever 180 by a roller pin 194 which is slidably and rotatably received in a pair of elongated kidney-shaped slots 196 formed in the depending flanges 165. The roller pin 194 is also slidably and rotatably received in an elongated kidney-shaped slot 198 (FIG. 19) formed near the upper end of the rear portion 188 of the firing lever 180. The roller pin 194 together with the slots 196 and 198 provide a pin and slot connection between the operating lever 160 and the firing lever 180. The opposite ends of the roller pin 194 are slidably received between a pair of spaced parallel guide rails 200 (FIGS. 5 and 7) which project inwardly from the housing sections 104 and 106. The movement of the roller pin 194 relative to the stapler housing 102 is restricted by the guide rails 200 and by an elongated rib 202 of reduced height located between the guide rails 200 on each of the housing sections 104 and 106.

Referring to FIG. 1, the staple actuator mechanism 110 includes a return spring 204 for normally biasing the lower firing lever 180 toward a rest position. The return spring 204 is embodied as a torsion coil spring including a plurality of coils 206 which encircle a semi-cylindrical post 208 formed on the housing section 104. The return spring has a rear arm 210 engaged with a tab 212 on the housing section 104. A post 213 (FIG. 7) on the interior of the housing section 106 is located to the side of the rear spring arm 210 to prevent the rear spring arm 210 from shifting laterally and being disengaged from the tab 212. The return spring 204 has a front arm 214 bent sideways to provide an offset portion 216 (FIG. 9) which extends across an elongated notch 218 (FIG. 19) formed at the rear of the firing lever 180. The spring 204 is maintained in torsion by the spring arms 210 and 214 which are engaged with the tab 212 and notch 218, respectively, to bias the firing lever 180 clockwise about the pivot pin 182 toward the rest position. The torsion of the spring 204 is transmitted by the roller pin 194 to the upper operating lever 160 to bias the operating lever 160 counterclockwise about the pivot pin 162 and to urge the handle assembly 108 toward its upwardly inclined rest position.

Figure 9:
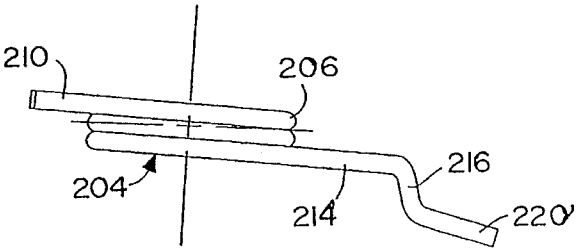
FIG. 9 is a top view of a torsion spring which forms part of the staple actuator mechanism.

As shown in FIGS. 1 and 9, the front arm 214 of the return spring 204 has a laterally slanted front tip 220 extending partially across the rear portion 188 of the firing lever 180 adjacent to the notch 218. The firing lever 180 has a corner 222 adjacent to the elongated notch 218 which overlaps the front arm 214 of the return spring 204. The front spring arm 214 exerts a lateral biasing force at the corner 222 on the rear portion 188 of the firing lever 180 to urge the front portion 186 of the firing lever laterally toward the housing section 104. However, as explained below, the lateral biasing force of the torsion spring arm 214 on the rear portion 188 of the firing lever 180 is counteracted by another force applied by a reset mechanism to the front portion 186 of the firing lever 180 to locate the firing lever 180 in its rest position and to maintain its front tip 190 in a desired alignment with the striker 112.

As shown in FIGS. 5 and 6, the cylindrical boss 184 on the housing section 104 has a raised arcuate surface or pad 228 located on its circular face in the quadrant extending upward and forward relative to the housing section 104. Similarly, as shown in FIGS. 7 and 8, the cylindrical boss 185 on the interior of the housing section 106 has a raised arcuate surface or pad 230 formed on its circular face in the quadrant extending upward and forward relative to the housing section 106. The arcuate pad 230 on the boss 185 is narrower than the arcuate pad 228 on the boss 184. The arcuate pads 228 and 230 serve as spacers which locate the lower firing lever 180 away from the circular faces of the cylindrical bosses 184 and 185 to facilitate the lateral rocking motion of the lower firing lever 180 about the pivot pin 182. An inclined guide rib 232 (FIG. 7) is formed on the interior of the housing section 106 to limit the lateral rocking motion of the front portion 186 of the firing lever 180.

As shown in FIGS. 1 and 19, an upwardly extending hook-like projection 234 is formed on the front portion 186 of the lower firing lever 180. The housing section 106 is provided with a ledge 236 (FIG. 7) which is located above and forward of the guide rib 232. Initially, when the lower firing lever 180 is pivoted to raise the striker 112, the front portion 186 of the lower firing lever 180 is slidably engaged with the adjacent face of the guide rib 232 and the hook-like projection 234 is slidably engaged with the adjacent face of the ledge 236. The guide rib 232 and the ledge 236 prevent the front portion of the lower firing lever 180 from being shifted laterally toward the housing section 106 until the front portion of the lower firing lever 180 is pivoted above the guide rib 232 and the hook-like projection 232 is moved above the ledge 236.

Figure 24:
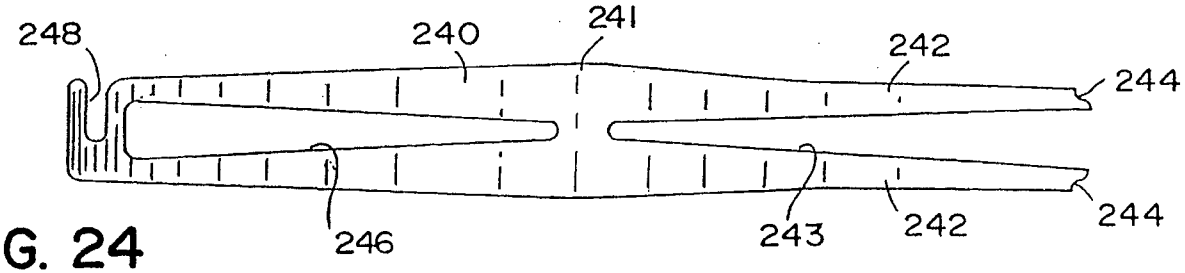
FIG. 24 is a top view of an actuator spring which forms part of the staple actuator mechanism.
Figure 25:
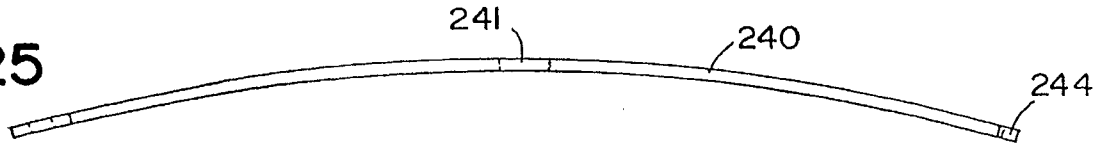
FIG. 25 is a side view showing the actuator spring of FIG. 24.

Referring to FIG. 1, the staple actuator mechanism 110 includes an actuator or power spring 240 in the form of an elongated leaf spring which extends along substantially the entire length of the stapler housing 102 and is coupled at its front end to the striker 112. As shown in FIGS. 24 and 25, the power spring 240 comprises a flat elongated metal leaf spring which has a wide mid-section 241 and tapers to a more narrow width toward the front and the back. The power spring 240 is bifurcated at its front end to provide a pair of elongated, tapered spring arms 242 which are spaced apart by a V-shaped slot 243 to receive the front portion 186 of the lower firing lever 180 therebetween. A pair of notches 244 is provided at the tips of the spring arms 242 for engagement with the striker 112. An elongated triangular slot 246 extends toward the rear end of the power spring 240 to receive the rear portion 188 of the firing lever 180. At the rear end of the power spring 240, an elongated lateral notch 248 extends to one side of the power spring 240. The rear end of the power spring 240 rests on a ledge 250 (FIG. 5) formed on the interior of the housing section 104. An elongated flange 252 is formed on the ledge 250 and is received in the lateral notch 248 to locate the power spring 240 longitudinally relative to the stapler housing 102. Similarly, the rear end of the power spring 240 rests on a ledge 254 (FIG. 7) formed toward the rear of the housing section 106. A lug 256 formed on the ledge 254 engages the side of the power spring 240 to retain the lateral flange 252 engaged in the lateral notch 248.

As shown in FIGS. 1 and 25, the power spring 240 is normally curved in a concave downward configuration to bias the striker 112 toward the bottom of the stapler housing 102. A rounded boss 258 is formed on each of the housing sections 104 and 106 approximately midway between the front and rear of the stapler housing 102. The rounded bosses 258 engage the top of the power spring 240 on the opposite sides of its mid-section 241. When the striker 112 is raised upward by operation of the staple actuator mechanism 110, the power spring 240 is flexed about the rounded bosses 258 into a concave upward configuration (FIG. 3) to load the power spring 240 for actuating the striker 112. When the striker 112 is released, the power spring 240 returns to its concave downward configuration (FIG. 4) to actuate the striker 112 and drive the frontmost staple 130 downward from the stapler housing 102.

Figure 13:
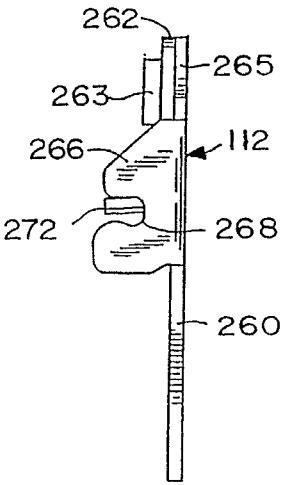
FIG. 13 is a side view showing the striker of FIG. 12.
Figure 14:
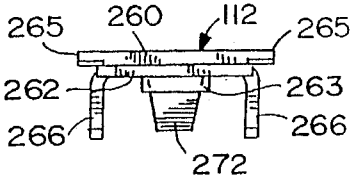
FIG. 14 is a top view showing the striker of FIG. 12.
Figure 12:
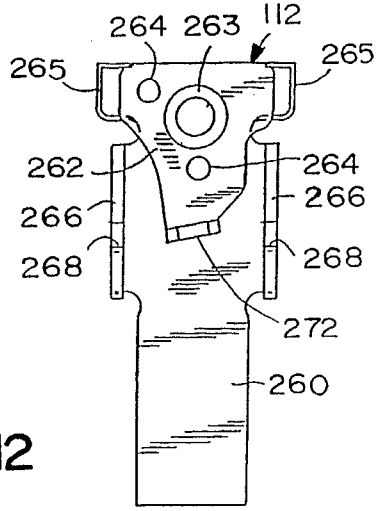
FIG. 12 is a rear view of a striker which forms part of the staple actuator mechanism.

Referring to FIGS. 12–14, the striker 112 is a two-part metal element consisting of a striker blade 260 for driving the staples 130 from the staple guide track 128 and a striker tongue 262 for engaging the front tip 190 of the lower firing lever 180. The striker blade 260 and the striker tongue 262 are joined together by conventional fastening techniques, e.g., by spot welding or a tox-point joint 263. A pair of dimples 264 is formed on the striker tongue 262 and received in corresponding recesses (not shown) formed on the striker blade 260 to align the tongue 262 with the blade 260. The striker blade 260 has a pair of ears 265 extending outwardly from its opposite sides which are slidably received in the vertical tracks 114 at the front of the housing sections 104 and 106. The striker blade 260 has a pair of rearwardly extending flanges 266 formed on its opposite sides and provided with slots 268 in which the notches 244 at the front of the power spring arms 242 are engaged. A pair of guide flanges 270 (FIGS. 5 and 7) is formed toward the front of the housing sections 104 and 106 for engaging the sides of the spring arms 242 to retain the notches 244 of the spring arms 242 engaged in the slots 268 of the striker flanges 266.

Normally, the frontmost staple 130 is urged by the staple pusher 132 into engagement with the rear face of the striker blade 260. When the striker 112 is raised (FIG. 3), the frontmost staple 130 is urged against the front wall of the nosepiece 140 by the staple pusher 132 and is aligned underneath the striker blade 260.

As shown in FIG. 12, the striker tongue 262 has a rearwardly extending tab 272 which is canted sideways at a predetermined angle, e.g., 8.5°, with the higher edge of the tab 272 facing toward the housing section 106 provided with the guide rib 232. As shown in FIG. 20, the front tip 190 of the firing lever 180 has an upper surface 274 which is canted at the same predetermined angle, e.g., 8.5°, to slidably engage the underside of the canted tab 272.

Figure 43:
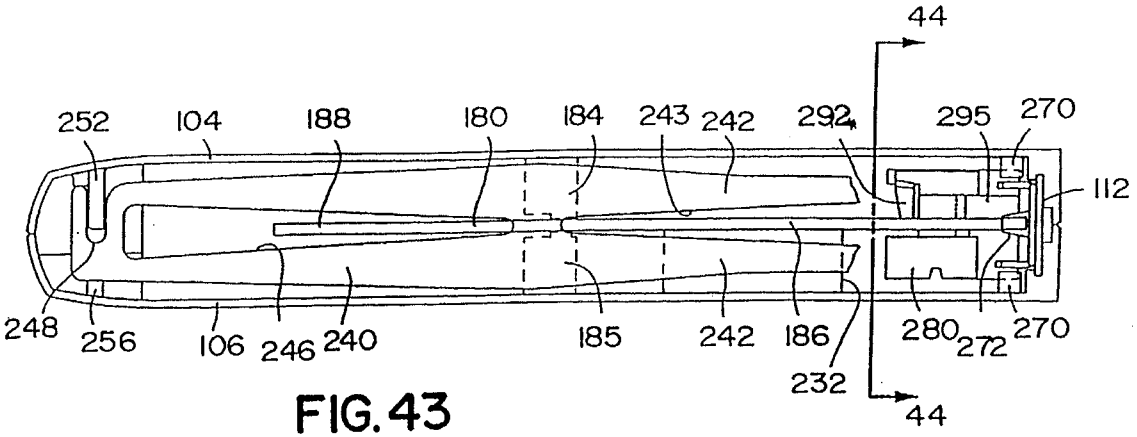
FIG. 43 is a partially cutaway top view of the stapler of FIG. 1 showing the firing lever and the striker in a rest position.

Referring to FIG. 43, the front tip 190 is positioned underneath the canted tab 272 of the striker 112 when the staple actuator mechanism 110 is in its rest position. When the front tip 190 of the firing lever 180 is raised, the canted surface 274 on the tip 190 is slidably engaged with the underside of the canted tab 272 on the striker 112. The engagement of the canted surface 274 with the canted tab 272 urges the front tip 190 of the firing lever 180 sideways along the underside of the canted tab 272 toward the housing section 106. However, the front portion 186 of the firing lever 180 engages the adjacent face of the guide rib 232 on the housing section 106 and the hook 234 on the firing lever 180 engages the adjacent face of the ledge 236 on the housing section 106 to prevent the front tip 190 of the firing lever 180 from being cammed out of engagement with the canted tab 272.

With the stapler actuator mechanism 110 in its rest position (FIG. 1), the front end of the power spring 240 rests on a molded plastic support member 280 mounted toward the front of the housing sections 104 and 106 adjacent to the striker 112. Preferably, the support member 280 consists of a thermoplastic elastomer, e.g., Hytrel, a trademark of the Dupont Company, which has a natural lubricity. The support member 280 limits the downward travel of the front end of the power spring 240 and the striker 112 and absorbs the impact of the power spring 240 when the stapler 100 is actuated.

As shown in FIGS. 26–31, the support member 280 is a block-like element having a pair of spaced parallel side walls 282 and 284 which are slanted downwardly toward the front and joined together by a thin flat base 286. The thicker side wall 282 has a vertical notch 287 for receiving a vertical rib 288 (FIG. 7) formed on the interior of the housing section 106. The thinner side wall 284 is cutaway at the rear to provide a recess 289 (FIG. 28) which receives a vertical rib 290 (FIG. 5) formed on the interior of the housing section 104. Another vertical rib 291 is formed on the housing section 104 to engage the front end of the side wall 284 of the support member 280.

Figure 30:
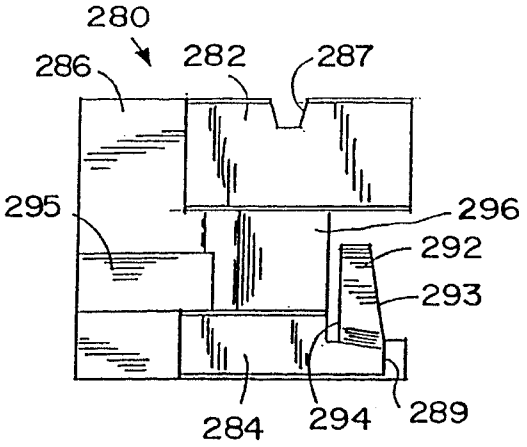
FIG. 30 is a top view showing the support member of FIG. 26.
Figure 29:
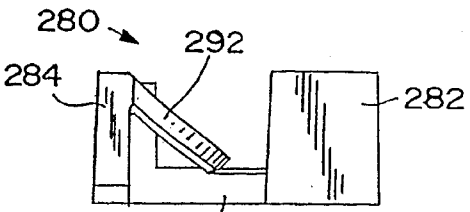
FIG. 29 is a rear view showing the support member of FIG. 26.
Figure 31:
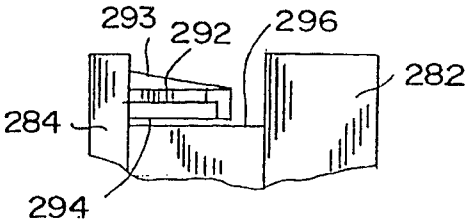
FIG. 31 is a bottom view of a rear portion of the support member of FIG. 26.
Figure 28:
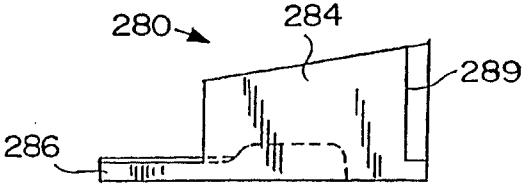
FIG. 28 is a side view showing the support member of FIG. 26.
Figure 26:
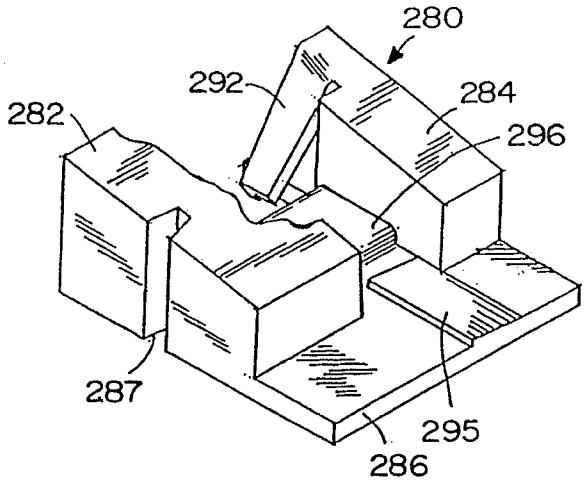
FIG. 26 is a perspective view of a support member which forms part of the actuator mechanism.
Figure 27:
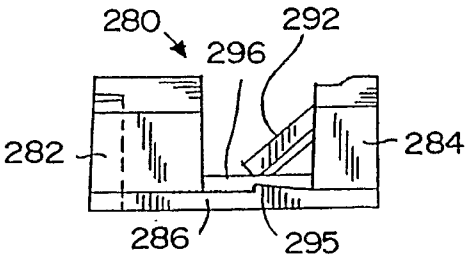
FIG. 27 is a front view showing the support member of FIG. 26.

As shown in FIG. 26, the support member 280 has a resilient finger 292 which slants downwardly and inwardly from the rear of the thinner side wall 284 into the space between the side walls 282 and 284. As shown in FIGS. 30 and 31, the resilient finger 292 has a generally T-shaped cross section which is partially cutaway to provide a slanted rear edge 293. The resilient finger 292 has a front edge 294 oriented perpendicularly inward from the side wall 284 of the support member 280.

The resilient finger 292 functions as a reset mechanism for shifting the lower firing lever 180 laterally into its rest position and to locate the front tip 190 of the firing lever 180 underneath the tab 272 of the striker 112. With the firing lever 180 located in its rest position, the resilient finger 292 exerts a lateral return force on the front portion 186 of the firing lever 180 which is sufficient to counterbalance the lateral bias force of the torsion spring arm 214 on the rear portion 188 of the firing lever to maintain the front tip 190 in a lateral position aligned with the tab 270 of the striker 112.

The support member 280 has a stop 295 formed as an inclined ramp at the front of the base 286 for engaging the front portion 186 of the firing lever 180 in its rest position to locate the front tip 190 of firing lever 180 in a predetermined lateral position relative to the striker 112. The stop 295 engages the front portion 186 of the firing lever 180 in its rest position to limit the lateral movement of the firing lever 180 under the urging of the return spring 204 and to limit the amount of bending of the resilient finger 292 in the rest position of the firing lever 180. The stop 295 enhances the longevity of the molded plastic resilient finger 292. The base 286 has a raised platform 296 extending laterally between the side walls 282 and 284 which is received in an elongated notch 298 (FIG. 19) near the front of the firing lever 180 in its rest position. The front edge 294 of the resilient finger 292 is spaced rearwardly from the platform 296 to provide clearance for movement of the resilient finger 292.

Referring to FIGS. 15–18, the upper operating lever 160 includes a pair of opposed lugs 302 and 304 formed on the depending flanges 165 and projecting inwardly therefrom. The lugs 302 and 304 receive an upper end of the rear portion 188 of the lower firing lever 180 therebetween and engage opposite sides of the firing lever 180 to guide the movement of the firing lever 180 relative to the operating lever 160 when the actuator mechanism 110 is operated.

As viewed from the side (FIGS. 16 and 17), each of the lugs 302 and 304 has an elongated rectangular shape. As viewed from above (FIG. 15), the lug 302 is generally flat and located slightly rearward of the lug 304 which has a rounded shape. The lugs 302 and 304 are formed as lances which are punched inwardly from the metal of the depending flanges 165. The rounded lug 304 is punched inwardly to a lateral depth which is greater than the lateral depth of the flat lug 302. The lug 302 has an inner flat bearing surface 303 and the lug 304 has an inner rounded bearing surface 305 for engaging the opposite sides of the rear portion 188 of the lower firing lever 180. The bearing surfaces 303 and 305 facilitate the pivoting and rocking movement of the firing lever 180. The rounded bearing surface 305 of the lug 304 provides a line-point contact with one side of the rear portion 188 of the firing lever 180 and permits a rolling action to occur when the firing lever 80 is rocked sideways relative to the pivot pin 182 in one direction. The flat bearing surface 303 of the lug 302 contacts the opposite side of the rear portion 188 of the firing lever 180 and functions as a spacer which permits less rolling action to occur when the firing lever 180 is rocked sideways about the pivot pin 182 in the other direction.

Figure 45:
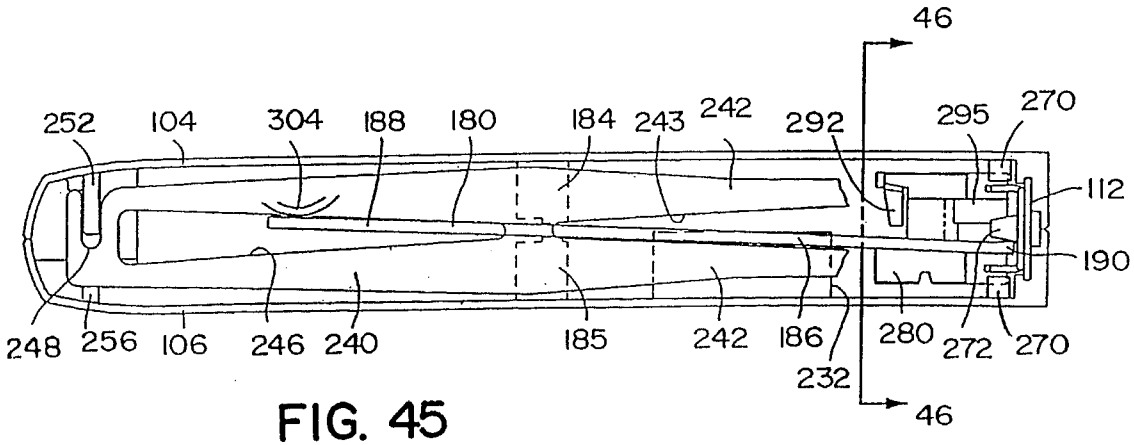
FIG. 45 is a partially cutaway top view of the stapler of FIG. 1 showing the firing lever and the striker at the top of the power stroke.

Referring to FIG. 45, when the lower firing lever 180 is rocked sideways to shift its front portion 186 toward the housing section 106, the rear portion 188 of the firing lever 180 engages the rounded lug 304 of the upper operating lever 160. The rounded lug 304 (FIG. 16) on the operating lever 160 and the arcuate pad 228 (FIG. 5) on the cylindrical boss 184 provide contact points which define an axis about which the lower firing lever 180 is rocked to achieve the shifting of the front portion 186 of the firing lever 180 toward the housing section 106.

Figure 47:
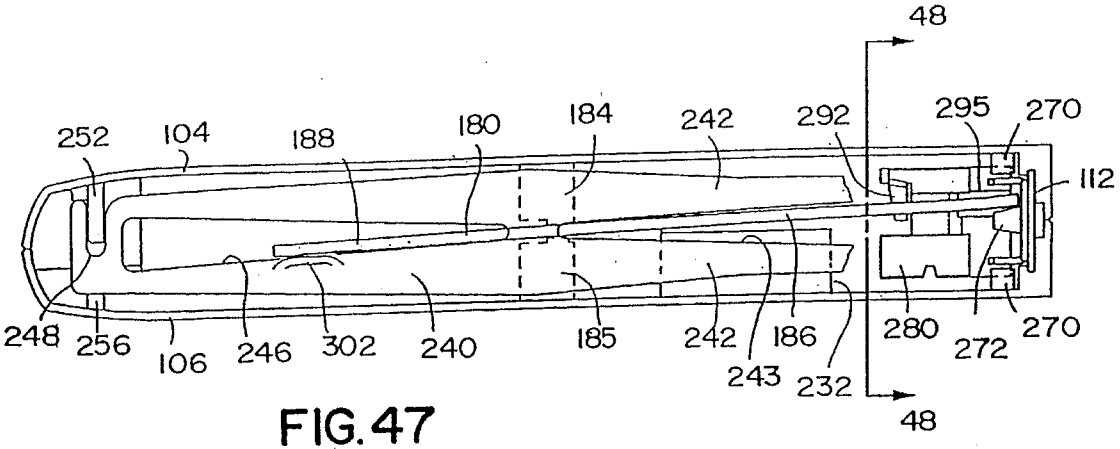
FIG. 47 is a partially cutaway top view of the stapler of FIG. 1 showing the firing lever at the beginning of its reset motion.

Referring to FIG. 47, when the lower firing lever 180 is rocked sideways to shift its front portion 186 toward the housing section 104, the rear portion 188 of the firing lever 180 engages the flat lug 302 of the upper operating lever 160. The flat lug 304 (FIG. 16) on the operating lever 160 and the arcuate pad 230 (FIG. 7) on the cylindrical boss 185 provide contact points which define an axis about which the lower firing lever 180 is rocked to achieve the shifting of the front portion 186 of the firing lever 180 toward the housing section 104.

Figure 22:
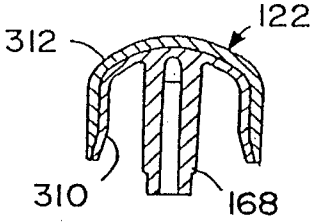
FIG. 22 is a vertical section of the handle along line 22—22 of FIG. 21.
Figure 21:
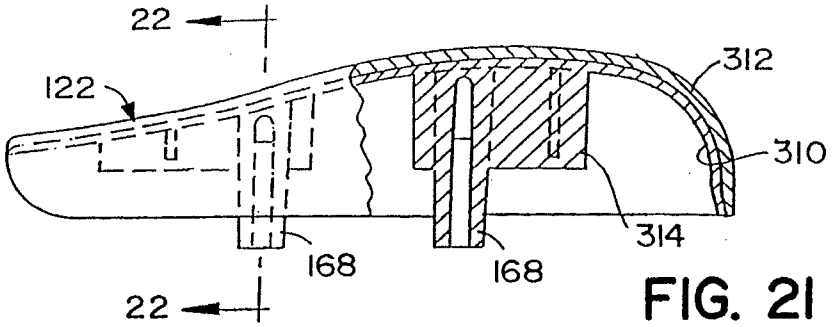
FIG. 21 is a partially cutaway side view of a handle which forms part of the staple actuator mechanism.
Figure 23:
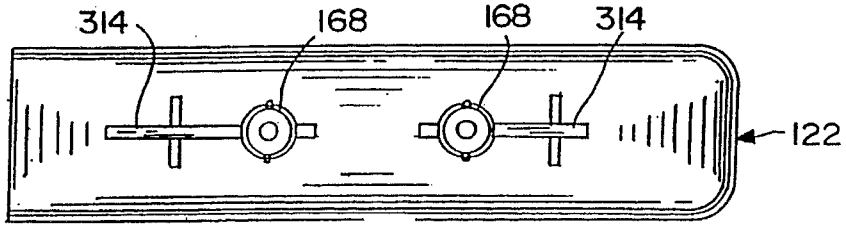
FIG. 23 is a bottom view showing the handle of FIG. 21.

Referring to FIGS. 21–23, the actuator handle 122 comprises a hollow elongated cover-like element formed as a two-part composite structure including a hollow elongated base member 310 to which an outer cover or shroud 312 is bonded. For example, the base member 310 is made of a hard thermoplastic elastomer such as polypropylene and the outer cover or shroud 312 is made of a softer thermoplastic elastomer, e.g., Vistaflex, a trademark of the Advanced Elastomers Company. The screw receiving stems 168 are cylindrical in shape and depend from the base member 310. The base member 310 has a pair of support flanges 314 (FIG. 23) which extend longitudinally from the cylindrical stems 168 and rest on the top wall 161 (FIG. 16) of the upper operating lever 160.

Figure 35:
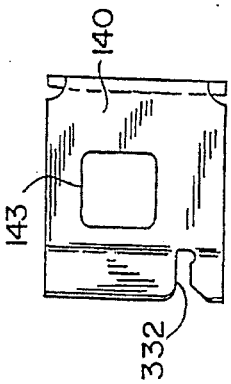
FIG. 35 is a side view of a nosepiece at the front of the staple feed mechanism.
Figure 36:
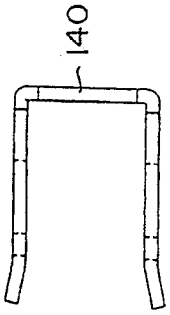
FIG. 36 is a bottom view of the nosepiece of FIG. 35.
Figure 34:
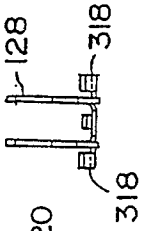
FIG. 34 is a front view showing the staple guide track of FIG. 32.
Figure 33:
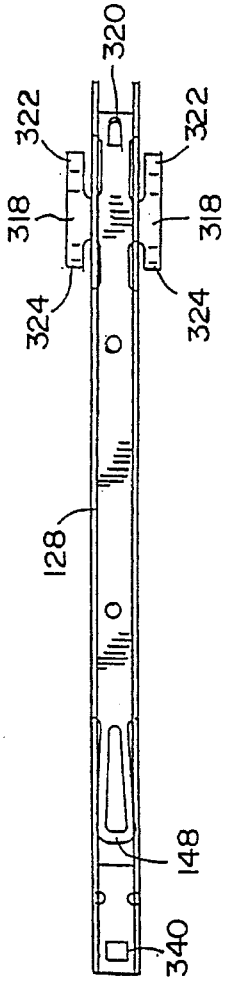
FIG. 33 is a bottom view showing the staple guide track of FIG. 32.
Figure 32:
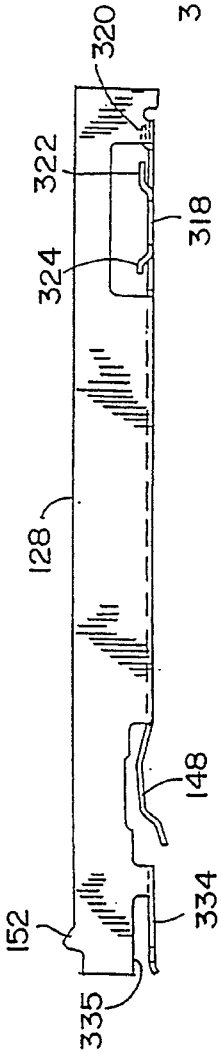
FIG. 32 is a side view of a staple guide track which forms part of a staple feed mechanism at the bottom of the stapler of FIG. 1.
Figure 39:
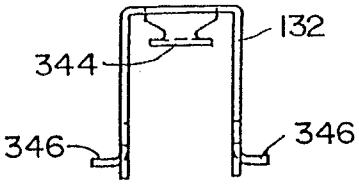
FIG. 39 is an end view showing the staple pusher of FIG. 37.

Referring to FIGS. 32–34, the staple guide track 128 is an elongated channel-shaped member and includes a pair of side flanges 318 which project outwardly in opposite directions at the lower front portion of the staple guide track 128. The staple guide track 128 has a front lug 320 for connection to the tension spring 134 (FIG. 1). Each side flange 318 is bent upwardly at its front and rear ends to provide an offset front tab 322 and an offset rear tab 324. The side flanges 318 are slidably received between a pair of elongated guide rails 326 and 328 (FIGS. 5 and 7) extending along the interior of the side wall 135 of each of the housing sections 104 and 106. A depending stop 330 (FIG. 5) is formed on the upper guide rail 326 of the housing section 104 for engaging the rear tab 324 (FIG. 33) on the corresponding side flange 318 to limit the rearward movement of the staple guide track 128 when it is pulled backward to load the staples 130 into the staple receiving channel 137 at the bottom of the stapler 100. The front tabs 322 on the side flanges 318 are received in corresponding notches 332 (FIG. 35) formed on opposite sides of the nosepiece 140 when the staple guide track 128 is pushed into the staple receiving channel 137 with the lugs 152 inserted into the notches 154.

Figure 40:
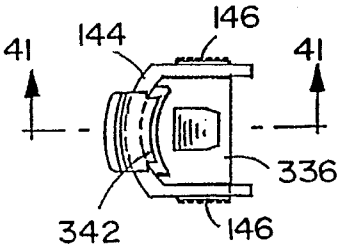
FIG. 40 is a top view of a pull member at the rear of the staple feed mechanism.
Figure 41:
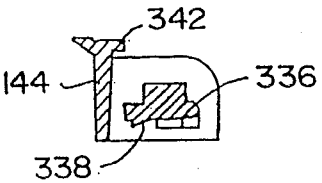
FIG. 41 is a vertical section of the pull member along line 41—41 of FIG. 40.
Figure 42:
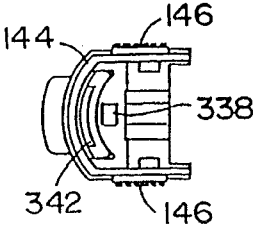
FIG. 42 is a bottom view showing the pull member of FIG. 40.
Figure 37:
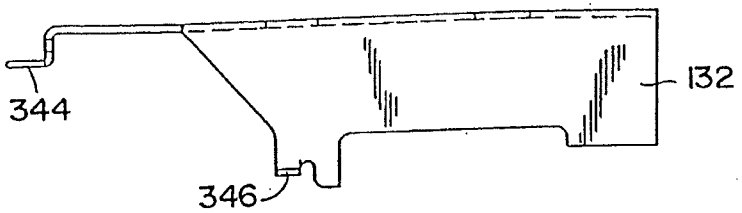
FIG. 37 is a side view of a staple pusher which forms part of the staple feed mechanism.

An arm 334 (FIG. 32) is provided at the lower rear portion of the staple guide track 128 for attachment to the track pull member 144. A longitudinal slot 335 is formed above the arm 334 on each side of the staple guide track 128 for receiving a ledge 336 (FIG. 40) extending transversely between the opposite sides of the U-shaped track pull member 144. A lug 338 (FIG. 42) on the underside of the ledge 336 is received in a corresponding opening 340 (FIG. 33) formed on the rear arm 334 of the staple guide track 128. An upper lip 342 (FIG. 41) on the track pull member 144 overlaps a top rear portion of the staple guide track 128 to complete the attachment of the track pull member 144 to the staple guide track 128.

Figure 38:
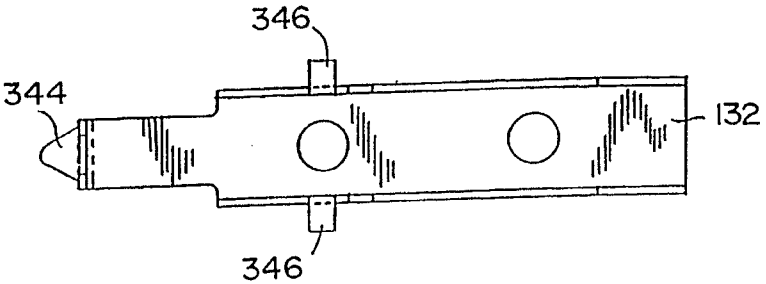
FIG. 38 is a bottom view showing the staple pusher of FIG. 37.

As shown in FIGS. 3–39, the staple pusher 132 is channel-shaped in configuration and adapted to slidably rest on the top of the staple guide track 128. The staple pusher 132 includes a rear finger 344 for connection to the tension spring 134 (FIG. 1). A pair of side lugs 346 (FIG. 38) which project outwardly from opposite sides of the pusher 132 are engaged by the rear tabs 324 (FIG. 33) on the side flanges 318 of the staple guide track 128 to limit the forward movement of the staple pusher 132 relative to the staple drive track 128 when the last staple 130 is driven from the stapler 100.

Generally, the stapler 100 is operated in the following manner. The stapler 100 is gripped by the hand of an operator with the thumb resting on the handle 122, the index finger extending through the front opening 116 and the remaining fingers extending through the elongated opening 118. The stapler 100 is positioned with its lower side walls 135 in contact with a surface or workpiece into which one of the staples 130 is to driven. The stapler 100 is actuated by depressing the handle 122 to operate the staple actuator mechanism 110 to reciprocate the striker 112 to drive the frontmost staple 130 into the adjacent surface or workpiece.

When the handle 122 is depressed by the operator, the upper operating lever 160 pivots downward relative to the stapler housing 102 and the front portion 186 of the firing lever 180 is pivoted upward to raise the striker 112 against the bias of the actuator spring 240. With the striker 112 raised to the top of the power stroke (FIG. 3), the front portion 186 of the firing lever 180 is located above the guide rib 232 and the hook-like projection 234 is moved above the ledge 236. The front portion 186 of the firing lever 180 is shifted laterally by the camming action of the front tip 190 against the striker tab 272 to move the front tip 190 to one side of the striker tab 272 and to release the striker 112 for actuation by the actuator spring 240. The striker 112 is driven downward by the actuator spring 240 to the bottom of the power stroke (FIG. 4) to drive the frontmost staple 130 from the stapler housing 102 into the adjacent surface or workpiece.

When the handle 122 is released by the operator, the front portion 186 of the firing lever 180 is shifted laterally in the opposite direction by the lateral biasing force of the return spring 204 to move the front tip 190 on the opposite side of the striker tab 272. The front portion 186 of the firing lever 180 is pivoted downward about the pivot pin 182 toward its rest position by the return spring 204 and the operating lever 160 is pivoted back to an upwardly inclined position. In addition, the front portion 186 of the firing lever 180 is shifted laterally to its rest position by the resilient finger 292 of the support member 280 to locate the front tip 190 of the firing lever 180 underneath the striker tab 272 for the next power stroke of the stapler 100.

Figure 44:
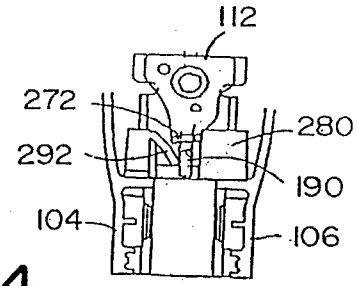
FIG. 44 is a vertical section of the stapler along line 44—44 of FIG. 43 with the firing lever cutaway to show the position of its front tip.

Referring to FIGS. 43 and 44, with the firing lever 180 in the rest position, its front tip 190 is located underneath the tab 272 on the striker 112. The front portion 186 of the firing lever 180 is urged laterally into engagement with the resilient finger 292 by the lateral biasing action of the return spring 204. The resilient finger 292 exerts a force on the front portion 186 of the firing lever 180 to counterbalance the action of the return spring 204 on the rear portion 188 of the firing lever 180 to locate the front tip 190 in the desired position underneath the tab 272 of the striker 112. The stop 295 on the support member 280 limits the bending of the resilient finger 292 in response to the lateral biasing force of the return spring 204 on the firing lever 180 and locates the front tip 190 in a predetermined lateral position relative to the striker tab 272.

When the front portion 186 of the firing lever 180 is pivoted upward by depressing the handle 122, the front tip 290 is moved upward into engagement with the underside of the striker tab 272. The resilient finger 292 remains engaged with the front portion 186 of the firing lever 180 to ensure that the front tip 190 moves upward into engagement with the striker tab 272. After the striker tab 272 is engaged by the front tip 190, the mechanical engagement therebetween resists the lateral biasing action of the return spring 204 and maintains the front tip 190 in engagement with the striker tab 272. Since the upper surface 274 of the front tip 190 is canted at the same angle as the striker tab 272, the tip 190 is urged in a first lateral direction (toward the housing section 106) to one side of the striker tab 272 as the front portion 186 of the firing lever 180 is pivoted upward. However, because the front portion 186 of the firing lever 180 is engaged with the adjacent face of the guide rib 232 and the hook-like projection 234 is engaged with the adjacent face of the ledge 236, the front tip 190 is maintained in engagement with the striker tab 272. The front tip 190 remains engaged with the striker tab 272 until the front portion 186 of the firing lever 180 is pivoted above the guide rib 232 and the hook-like projection 234 is moved above the ledge 236 at the top of the power stroke.

Figure 46:
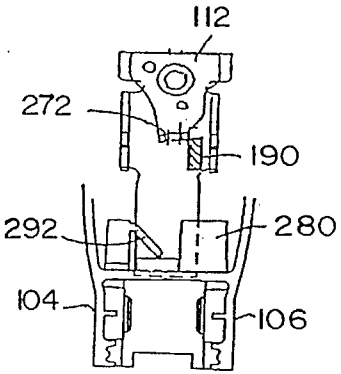
FIG. 46 is a vertical section of the stapler along line 46—46 of FIG. 45 with the firing lever cutaway to show the position of its front tip.

Referring to FIGS. 45 and 46, at the top of the power stroke, with the front portion 186 of the firing lever 180 pivoted above the guide rib 232, the front tip 190 is shifted in the first lateral direction to one side of the tab 272 to release the striker 112 for actuation by the actuator spring 240. When the front tip 190 is disengaged from the underside of the tab 272, the striker 112 is driven rapidly downward by the actuator spring 240 to drive the frontmost staple 130 from the stapler housing 102 into the adjacent surface or workpiece. As the striker 122 is driven downward, the striker tab 272 slides along the adjacent side of the front tip 190. The front portion 186 of the firing lever 180 is located above the guide rib 232. Also, the hook 234 on the front portion 186 of the firing lever 180 is shifted laterally into engagement with the ledge 236 on the housing section 106.

Figure 48:
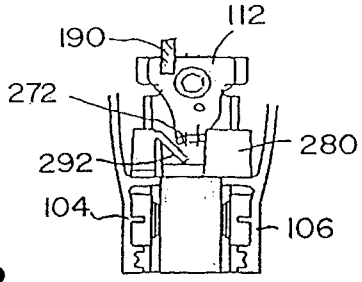
FIG. 48 is a vertical section of the stapler along line 48—48 of FIG. 47 with the firing lever cutaway to show the position of its front tip.

Referring to FIGS. 47 and 48, after the striker 112 is driven downward by the actuator spring 240, the front portion 186 of the firing lever 180 is shifted in a second or opposite lateral direction (toward the housing section 104) by the lateral biasing action of the return spring 204 when the actuator handle 122 is released. The front tip 190 is shifted to the opposite side of the striker tab 272 for the return movement of the firing lever 180 to its rest position. The front portion 186 of the firing lever 180 is displaced away from the guide rib 232. Also, the hook 234 on the front portion 186 of the firing lever 180 is moved away from the ledge 236 on the housing section 106.

Figure 50:
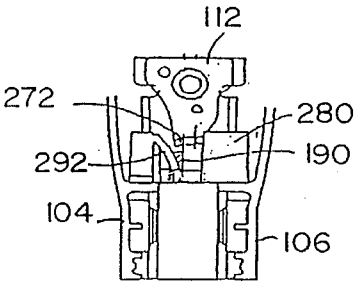
FIG. 50 is vertical section of the stapler along line 50—50 of FIG. 49 with the firing lever cutaway to show the position of its front tip.
Figure 49:
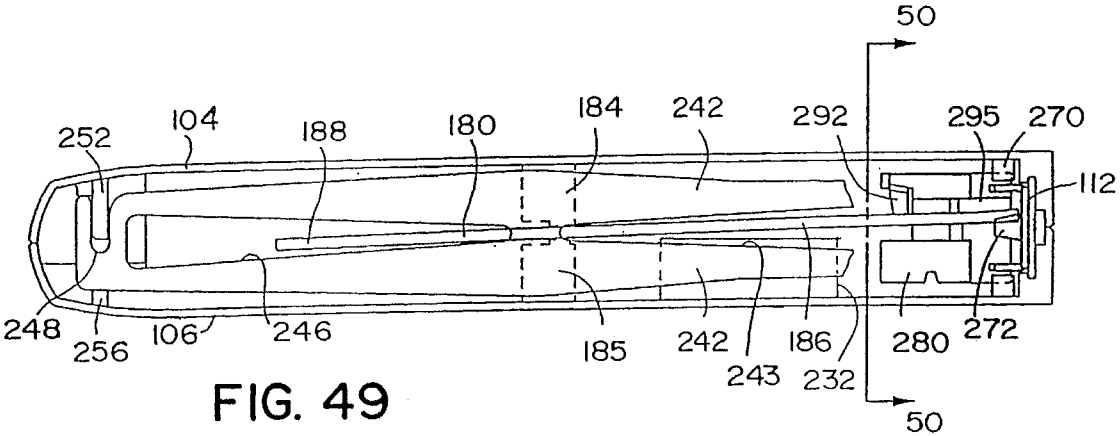
FIG. 49 is a partially cutaway top view of the stapler of FIG. 1 showing the return movement of the firing lever toward its rest position.

Referring to FIGS. 49 and 50, as the front portion 186 of the firing lever 180 pivots downward toward its rest position, the resilient finger 292 engages the front portion 186 of the firing lever 180 and shifts the front tip 190 in the first lateral direction relative to the striker tab 272. Initially, the resilient finger 292 urges the front tip 190 of the firing lever 180 laterally against the adjacent side of the striker tab 272. The front tip 190 slides downward along the adjacent side of the striker tab 272 until the front tip 190 is moved to a position under the striker tab 272. Then the resilient finger 292 shifts the front portion 186 of the firing lever 180 in the first lateral direction into its rest position to locate the front tip 190 underneath the striker tab 272.

When the firing lever 180 is returned to its rest position, the front tip 190 is located in a lateral position underneath the striker tab 272 where the lateral biasing action of the return spring 204 on the rear portion 188 of the firing lever 180 is counterbalanced by the action of the resilient finger 292 against the front portion 186 of the firing lever 180. The front tip 190 is accurately located underneath the striker tab 272 for the next power stroke of the stapler 100. The stop 295 limits the lateral movement of the front portion 186 of the firing lever 180 by the lateral biasing action of the return spring 204 and limits the amount of bending of the resilient finger 292 in the rest position of the firing lever 180.

It will be appreciated from the foregoing that an impact stapler is provided which is reliable in operation and easily and accurately assembled. The reset feature of the staple actuator mechanism 110 is adapted to reliably shift the firing lever 180 laterally into its rest position. This reset feature is provided by the resilient finger 292 which is mounted at a position adjacent to the striker 112 and acts on a front portion 186 of the firing lever 180 adjacent to the striker 112 to achieve reliable positioning of the front tip 190 underneath the striker tab 272. Also, because the action of the return spring 204 is simplified, the components of the stapler 100 are easy to assemble and provide a staple actuator mechanism 110 which is consistent in operation.

The invention in its broader aspects is not limited to the specific details of the preferred embodiments shown and described, and those skilled in the art will recognize that the invention can be practiced with modification within the spirit and scope of the appended claims.

We claim:

1. A fastening device, comprising:

a housing;

an operating lever pivotally mounted on said housing;

a striker located within said housing and oriented to drive a fastener from said housing;

an actuator spring coupled to said striker and adapted to bias said striker for driving the fastener from said housing;

a firing lever pivotally mounted on said housing and operable by said operating lever for raising said striker against the bias of said actuator spring, said firing lever being adapted to shift laterally relative to said striker and being normally located in a rest position;

said firing lever being positioned to engage said striker when said operating lever is actuated to raise said striker, and said firing lever being shifted laterally to release said striker for actuation by said actuator spring after said striker is raised; and reset means adjacent to said striker for shifting said firing lever laterally into its rest position.

2. The fastening device of claim 1, wherein:

said reset means is mounted on said housing at a position adjacent to said striker.

3. The fastening device of claim 1, wherein:

said reset means acts on a portion of said firing lever adjacent to said striker.

4. The fastening device of claim 1, wherein said reset means comprises:

a resilient biasing member mounted on said housing and adapted to engage a portion of said firing lever adjacent to said striker for urging said firing lever in a lateral direction to its rest position.

5. The fastening device of claim 1, wherein said reset means comprises:

a resilient finger mounted on said housing adjacent to said striker for urging said firing lever in a lateral direction to its rest position.

6. The fastening device of claim 5, which includes:

a stop located adjacent to said striker for engaging said firing lever in its rest position to locate said firing lever in a predetermined lateral position relative to said striker.

7. The fastening device of claim 1, which includes:

stop means for engaging said firing lever in its rest position to locate said firing lever in a predetermined lateral position relative to said striker.

8. The fastening device of claim 1, wherein:

said operating lever has a pair of opposed lugs which receive a portion of said firing lever therebetween and engage opposite sides of said firing lever to guide the movement of said firing lever relative to said operating lever.

9. The fastening device of claim 8, wherein:

said lugs consist of inwardly projecting lances formed on opposite sides of said operating lever.

10. The fastening device of claim 8, wherein:

one of said lugs has a flat bearing surface and the other of said lugs has a rounded bearing surface for engaging said firing lever.

11. A fastening device, comprising:

a housing;

an operating lever pivotally mounted on said housing;

a striker located within said housing and oriented to drive a fastener from said housing;

an actuator spring coupled to said striker and adapted to bias said striker for driving the fastener from said housing;

a firing lever pivotally mounted on said housing and operable by said operating lever for raising said striker against the bias of said actuator spring, said firing lever being adapted to shift laterally relative to said striker and being normally located in a rest position;

said firing lever being positioned to engage said striker when said operating lever is actuated to raise said striker, and said firing lever being shifted laterally to release said striker for actuation by said actuator spring after said striker is raised; and stop means for engaging said firing lever in its rest position to locate said firing lever in a predetermined lateral position relative to said striker.

12. A fastening device, comprising:

a housing;

an operating lever pivotally mounted on said housing;

a striker located within said housing and oriented to drive a fastener from said housing;

an actuator spring coupled to said striker and adapted to bias said striker for driving the fastener from said housing;

a firing lever pivotally mounted on said housing and operable by said operating lever for raising said striker against the bias of said actuator spring, said firing lever being adapted to shift laterally relative to said striker and being normally located in a rest position;

said firing lever being positioned to engage said striker when said operating lever is actuated to raise said striker, and said firing lever being shifted laterally to release said striker for actuation by said actuator spring after said striker is raised; and said operating lever having a pair of opposed lugs which receive a portion of said firing lever therebetween and engage opposite sides of said firing lever to guide the movement of said firing lever relative to said operating lever.

13. The fastening device of claim 12, wherein:

said lugs consist of inwardly projecting lances formed on said depending flanges.

14. The fastening device of claim 12, wherein:

one of said lugs has a flat bearing surface and the other of said lugs has a rounded bearing surface for engaging said firing lever.

15. A fastening device, comprising:

a housing;

an operating lever pivotally mounted on said housing;

a striker located within said housing and oriented to drive a fastener from said housing;

an actuator spring coupled to said striker and adapted to bias said striker for driving the fastener from said housing;

a firing lever pivotally mounted on said housing and operable by said operating lever for raising said striker against the bias of said actuator spring, said firing lever being adapted to shift laterally relative to said striker;

said firing lever being positioned underneath a tab on said striker when said operating lever is actuated to raise said striker, and said firing lever being shifted in a first lateral direction to one side of said tab to release said striker for actuation by said actuator spring after said striker is raised;

a return spring for normally biasing said firing lever toward a rest position, said return spring being adapted to urge said firing lever in a second lateral direction to shift said firing lever to the opposite side of said tab after said striker is actuated; and reset means adjacent to said striker for shifting said firing lever in the first lateral direction into its rest position underneath said striker tab.

16. The fastening device of claim 15, wherein:

said reset means is mounted on said housing at a position adjacent to said striker.

17. The fastening device of claim 15, wherein:

said reset means acts on a portion of said firing lever adjacent to said striker.

18. The fastening device of claim 15, wherein said reset means comprises:

a resilient biasing member mounted on said housing and adapted to engage a portion of said firing lever adjacent to said striker for urging said firing lever in the first lateral direction to its rest position.

19. The fastening device of claim 18, wherein:

said resilient biasing member is adapted to counterbalance the action of said return spring on said firing lever in its rest position to maintain said firing lever underneath said tab.

20. The fastening device of claim 15, wherein said reset means comprises:

a resilient finger mounted on said housing adjacent to said striker for urging said firing lever in the first lateral direction to its rest position.

21. The fastening device of claim 20, wherein:

said resilient finger engages said firing lever in its rest position to counterbalance the action of said return spring and to maintain said firing lever underneath said tab.

22. The fastening device of claim 20, which includes:

a stop located adjacent to said striker for engaging said firing lever in its rest position to locate said firing lever in a predetermined lateral position relative to said striker.

23. The fastening device of claim 22, wherein:

said resilient finger and said stop are formed on a support member adjacent to said striker.

24. The fastening device of claim 23, wherein:

said support member is adapted to absorb the impact of said actuator spring when said striker is actuated.

25. The fastening device of claim 15, which includes:

stop means for engaging said firing lever in its rest position to locate said firing lever in a predetermined lateral position relative to said striker.

26. The fastening device of claim 15, wherein:

said operating lever has a pair of opposed lugs which receive a portion of said firing lever therebetween and engage opposite sides of said firing lever to guide the movement of said firing lever relative to said operating lever.

27. The fastening device of claim 26, wherein:

said lugs consist of inwardly projecting lances formed on said operating lever.

28. The fastening device of claim 26, wherein:

one of said lugs has a flat bearing surface and the other of said lugs has a rounded bearing surface for engaging said firing lever.

* * * * *

UNITED STATES PATENT AND TRADEMARK OFFICE

CERTIFICATE OF CORRECTION

PATENT NO. : 5,497,932

DATED : March 12, 1996

INVENTOR(S) : Kevin D. Brewer and Stephen A. Debelius

It is certified that error appears in the above-identified patent and that said Letters Patent is hereby corrected as shown below:

On the title page: Item [73]

the Assignee should appear as follows:

Black & Decker Inc.

Signed and Sealed this

Fourth Day of March, 1997

*Attest:*

Bruce Lehman

BRUCE LEHMAN

*Attesting Officer*

*Commissioner of Patents and Trademarks*